US005515581A

United States Patent [19]

Kaufmann

[11] Patent Number: 5,515,581

[45] Date of Patent: May 14, 1996

[54] MAGNETIC SAFETY SNAP LOCKING DEVICE

[76] Inventor: Eli Kaufmann, 939 51st St., Brooklyn, N.Y. 11219

[21] Appl. No.: 243,300

[22] Filed: May 17, 1994

[51] Int. Cl.[6] ..... A45C 13/12; A44B 17/00

[52] U.S. Cl. ..... 24/303

[58] Field of Search ..... 24/303, 658, 657, 24/656, 642, 639, 634, 635, 648; 248/206.5; 292/251.5

[56] References Cited

U.S. PATENT DOCUMENTS

| | | | |
|---|---|---|---|
| 941,096 | 11/1909 | Pugatsky . | |
| 1,271,650 | 7/1918 | Arkin . | |
| 1,305,979 | 6/1919 | Cobe | 24/657 |
| 2,288,688 | 7/1942 | Dubilier . | |
| 2,475,226 | 7/1949 | Ellis . | |
| 2,648,884 | 8/1953 | Lcofboro . | |
| 2,784,475 | 3/1957 | Schmitt | 24/635 |
| 2,959,832 | 11/1960 | Baermann . | |
| 3,027,617 | 4/1962 | Gray . | |
| 3,934,909 | 1/1976 | Van Natter . | |
| 4,121,324 | 10/1978 | Marbacher . | |
| 4,587,695 | 5/1986 | Jensen . | |
| 4,622,726 | 11/1986 | Nakamura . | |
| 5,076,623 | 12/1991 | Richards . | |
| 5,199,138 | 4/1993 | Morita . | |
| 5,253,394 | 10/1993 | Morita . | |
| 5,530,862 | 12/1994 | Teed . | |

FOREIGN PATENT DOCUMENTS

| | | | |
|---|---|---|---|
| 1465402 | 12/1966 | France . | |
| 367526 | 1/1923 | Germany | 24/634 |
| 444552 | 2/1968 | Switzerland . | |

*Primary Examiner*—James R. Brittain

*Attorney, Agent, or Firm*—Oblon, Spivak, McClelland, Maier & Neustadt

[57] ABSTRACT

The present invention relates to a magnetic safety snap locking device which utilizes cooperating male and female members as well as the attraction of a permanent magnet. In the present invention, the female member comprises sliding or pivoting members which cooperate to define an opening. The opening is sized so as to permit a magnetic portion of a male member to be inserted therethrough. The locking device of the present invention uses the magnetically attracting force between surfaces on at least one of the sliding or pivoting members of the female member and corresponding surfaces on the magnetic portion of the male member to achieve the desired magnetic and mechanical engagement of the male member to the female member. The magnetic and mechanical disengagement of the male and female members is achieved by a sliding or pivoting movement of at least one of the sliding or pivoting members. The female member of the present invention further comprises a simplified casing structure for enclosing the sliding or pivoting members and is suitable for inexpensive mass production. The casing structure with the sliding or pivoting members disposed therein can be enclosed in a decorative housing.

24 Claims, 8 Drawing Sheets

FIG. 8B
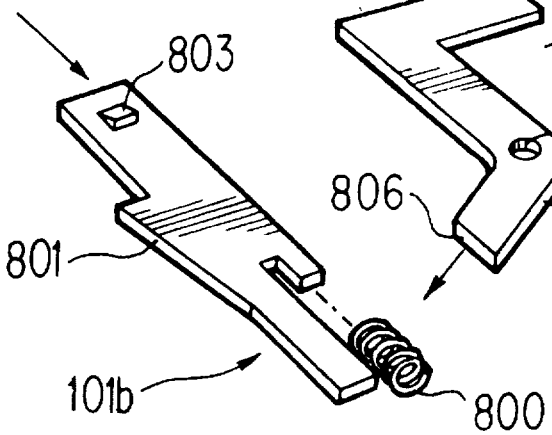
FIG. 8C
FIG. 8D
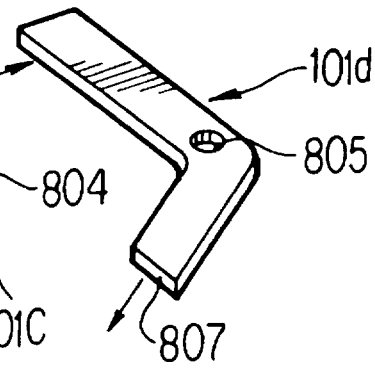
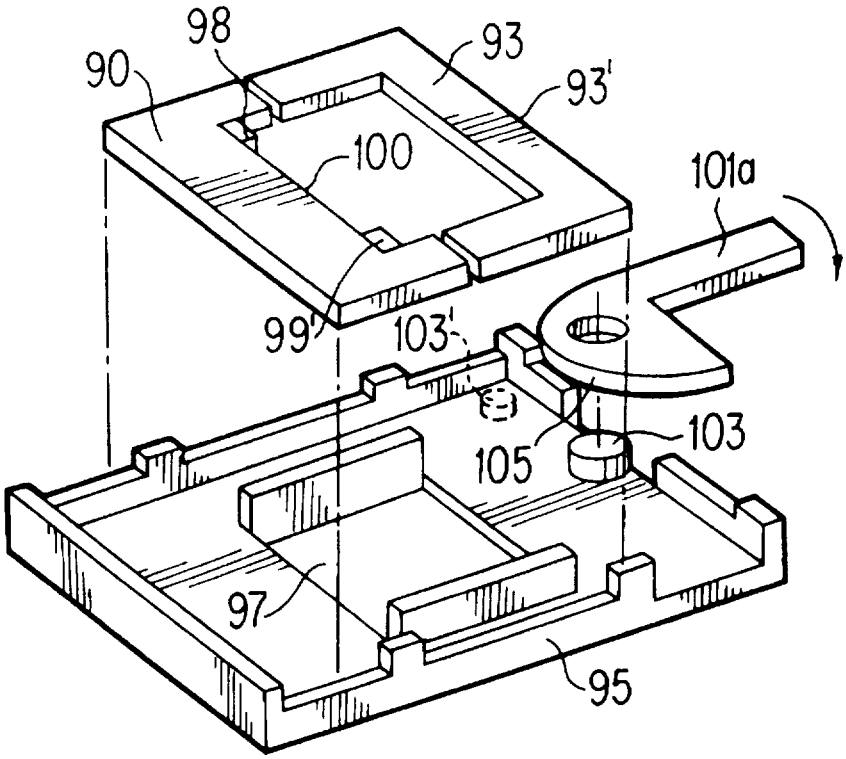
FIG. 8A

FIG. 12A
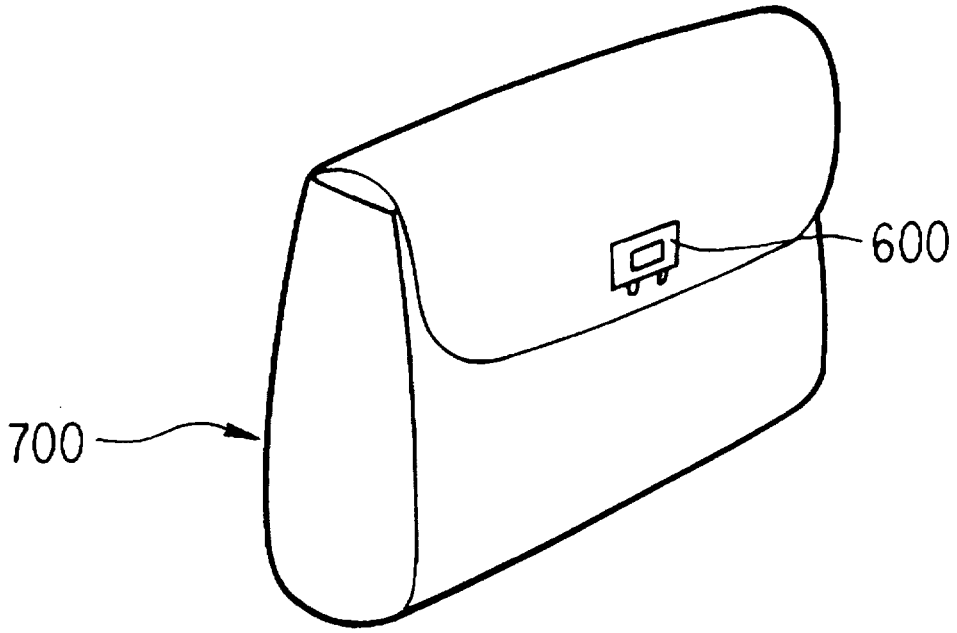
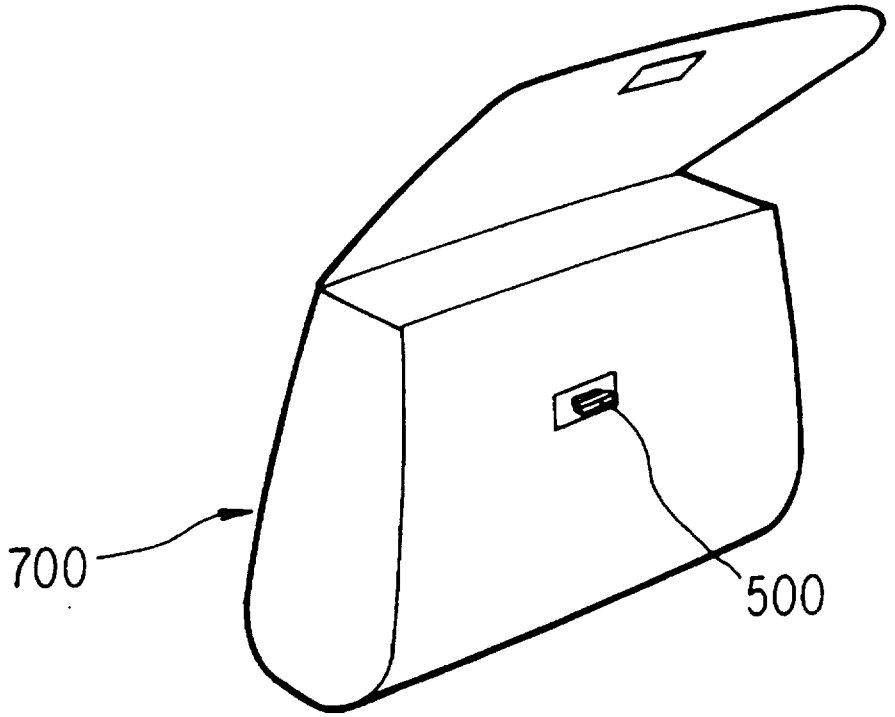
FIG. 12B

MAGNETIC SAFETY SNAP LOCKING DEVICE

BACKGROUND OF THE INVENTION

1. Field of the Invention

The present invention relates to a magnetic safety snap locking device for various types of bags such as handbags, briefcases and backpacks and for various types of boxes, belts and other types of fasteners used for keeping door-type structures either opened or closed.

2. Discussion of the Related Art

Fastening devices which utilize the combination of interconnecting male and female members and the attractive force of a magnet are advantageous in that they are easy to use and the female member can be easily attracted to and detached from the male member. However, conventional fastening devices have drawbacks in that they do not provide for a sufficiently positive closure between the male and female member and thus when a force or an impact stronger than the attraction force of the permanent magnet is exerted on either the male or female members, they become easily disengaged.

Additionally, it is difficult to mass-produce conventional fastening devices due to the fact that they tend to have a complicated structure and include a large number of component parts.

SUMMARY OF THE INVENTION

An object of the present invention is to provide for a magnetic safety snap locking device having a strong closure between the male and female members of the locking device to resist the disengagement of the male and female members when a strong force is exerted on the locking device.

A further object of the present invention is to provide for a magnetic safety snap locking device which is simple in construction and suitable for mass-production.

A further object of the present invention is to provide for a magnetic safety snap locking device which enables a rapid and accurate assembly of the component parts of the device by either a fully or partially automated process.

A further object of the present invention is to provide for a magnetic safety snap locking device which includes a basic locking structure that is inexpensive to produce and can be manufactured in several standard sizes.

The magnetic safety snap locking device of the present invention comprises a male member having a magnetic portion; a female member comprising first and second overlapping plates which are slidable with respect to each other, the first and second overlapping plates defining a first opening for permitting the magnetic portion of the male member to be inserted therethrough, the first plate comprising a first magnetically attracting surface and the second plate comprising a second magnetically attracting surface, each of the first and second magnetically attracting surfaces being attracted to the magnetic portion of the male member when the magnetic portion is inserted through the first opening so as to magnetically and mechanically engage the male member to the female member; and moving means operationally connected to each of the first and second plates for moving each of the first and second plates with respect to each other to enlarge the first opening and move the first and second attracting surfaces of the first and second plates away from the magnetic portion of the male member, to thereby permit the magnetic portion to pass through the first opening so as to disengage the male member from the female member.

The present invention further relates to a magnetic safety snap locking device comprising a male member having a magnetic portion, the magnetic portion comprising an end surface and locking end notched surfaces; and a female member comprising first and second plates, the first and second plates defining a first opening between them for permitting the magnetic portion of the male member to be inserted therethrough, wherein one of the first and second plates is a locking plate and comprises a magnetically attracting face surface and notched end portions, such that when the magnetic portion of the male member is inserted through the first opening, the face surface of the locking plate is attracted to the end surface of the magnetic portion of the male member, and the notched end portions of the locking plate is attracted to the locking end notched surfaces of the magnetic portion, to thereby fasten the male member to the female member on at least two sides of the magnetic portion.

The present invention further relates to a magnetic safety snap locking device comprising a male member having a magnetic portion; a female member comprising first and second members pivotally attached to each other about a pivot point, the first member comprising a first magnetically attracting surface and the second member comprising a second magnetically attracting surface, the first and second magnetically attracting surfaces being attracted to the magnetic portion when the magnetic portion is inserted through a space defined between the first and second members so as to magnetically and mechanically engage the male member with the female member; and a scissor-like engagement release means abutting against end or side portions of each of the first and second members which are opposite to the pivot point, the scissor-like engagement release means pivoting each of the first and second members about the pivot point in a direction away from the magnetic portion so as to release the magnetic attraction and mechanical engagement between the first and second attracting surfaces and the magnetic portion and permit the magnetic portion to pass through the space to allow the male member to be magnetically and mechanically disengaged from the female member.

The present invention further relates to a magnetic safety snap locking device which comprises a male member having a magnetic portion; and a female member comprising a scissor-like attraction member, the scissor-like attraction member comprising first and second members pivotally attached to each other about a pivot point, a first end of the scissor-like attraction member comprising first and second attracting surfaces on respective ones of each of the first and second members, the first and second members defining a first opening at the first end of the scissor-like attraction member for permitting the magnetic portion of the male member to be inserted therethrough, each of the first and second attracting surfaces being magnetically attracted to the magnetic portion when the magnetic portion is inserted through the opening for magnetically and mechanically engaging the male member to the female member. The first and second members are pivotable about the pivot point to move the first and second attracting surfaces away from the magnetic portion and release the magnetic attraction and mechanical engagement between the first and second magnetically attracting surfaces and the magnetic portion, to thereby permit the magnetic portion to pass through the opening.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 8(A) illustrates a fourth embodiment of the magnetic safety snap locking device of the present invention;

FIGS. 8(B), 8(C) and 8(D) illustrate different types of actuators which can be utilized in at least the embodiment of FIG. 8(A);

FIGS. 12(A) and 12(B) illustrate an example of a handbag on which the locking device of the present invention can be utilized.

DESCRIPTION OF THE PREFERRED EMBODIMENTS

Figure 1:
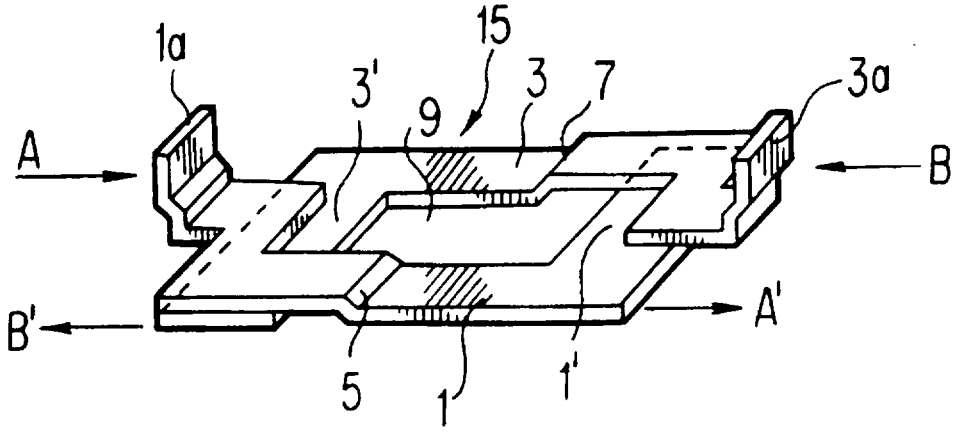
FIG. 1 illustrates a first embodiment of the sliding component which is part of the female member of the inventive magnetic safety snap locking device.

Referring now to the drawings, the magnetic safety snap locking device of the present invention utilizes interconnecting male and female members with the female member having a sliding or pivoting component. FIG. 1 illustrates a first embodiment of a sliding component 15 which makes up part of the female member of the inventive magnetic safety snap locking device. As illustrated in FIG. 1, the sliding component 15 includes a first substantially C or L-shaped sliding plate or bar 1 and a second substantially C or L-shaped sliding plate or bar 3. Each of the sliding plates 1 and 3 have sloping portions 5 and 7 which permit the first and second sliding plates to be positioned in the overlapping manner illustrated in FIG. 1. When the first and second sliding plates 1 and 3 are positioned in the overlapping manner illustrated in FIG. 1, an opening 9 is created between each of the first and second plates 1 and 3. As further illustrated in FIG. 1, the first sliding plate 1 includes an upwardly extending handle la, and the second sliding plate 3 includes an upwardly extending handle 3*a*. It is noted that the handles 1*a* and 3*a* are shown for illustrative purposes and any equivalent means which can cause the sliding or movement of the first plate 1 with respect to the second plate 3 can be utilized.

Figure 3:
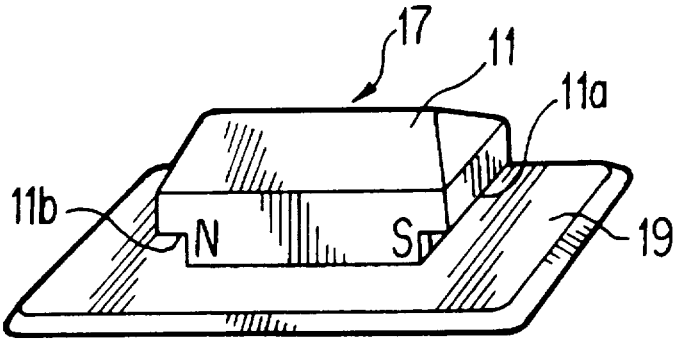
FIG. 3 illustrates an embodiment of the male member of the inventive magnetic safety snap locking device.

Referring now to FIG. 3, a male member 17 is illustrated. As illustrated in FIG. 3, the male member includes a base portion 19 and a magnetic portion 11. The cross-sectional shape of the male member illustrated in FIG. 3 is just a single example of the shape of the male member which can be utilized in the present invention. It is recognized that a male member having a rectangular, square, circular or oval cross-sectional shape can be utilized in the present invention.

During use of the locking device of this embodiment, the male member 17 is inserted into the sliding component 15 such that the magnetic portion 11 passes through the opening 9. When the magnetic portion 11 passes through the opening 9, a first magnetically attracting surface 1' on the first sliding plate 1 is attracted to a surface 11*a* on the magnetic portion 11, and a second magnetically attracting surface 3' on the second sliding plate 3 is attracted to a surface 11*b* on the magnetic portion 11. With this arrangement, the male member 17 is firmly magnetically and mechanically engaged with the sliding component 15 of the female member due to the magnetic attraction between the surfaces 1' and 11a and 3' and 11*b*. When it is desired to disengage the male member 17 from the sliding component 15 of the female member, a user simply pushes the handles 1*a* and 3*a* in the respective directions illustrated by the arrows A and B in FIG. 1 so as to respectively slide the sliding plates 1 and 3 in the directions illustrated by the arrows A' and B' in FIG. 1. This sliding movement enlarges the opening 9 so as to move the magnetically attracting surfaces 1' and 3' away from the magnetic portion 11 and thereby release the magnetic attraction and mechanical engagement between the magnetic portion 11 and the magnetically attracting surfaces 1' and 3'. The enlargement of the opening 9 permits the magnetic portion 11 to pass through the opening 9 and thereby enables the disengagement of the sliding component 15 of the female member from the male member 17.

Figure 4:
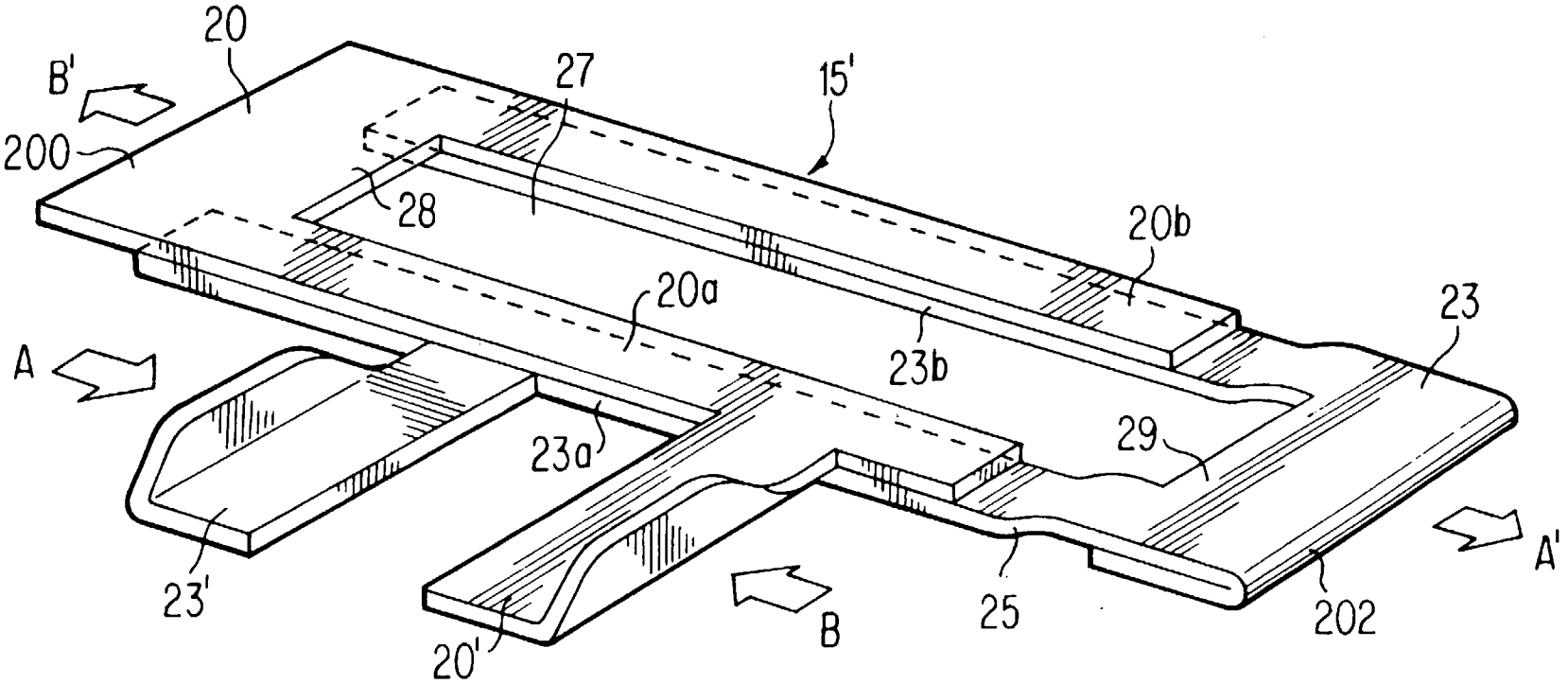
FIG. 4 illustrates a second embodiment of the sliding component which is part of the female member of the inventive magnetic safety snap locking device.

FIG. 4 illustrates a second embodiment of a sliding component 15' which makes up part of the female member of the present invention. The sliding component 15' of FIG. 4 includes a first sliding plate or bar 20 and a second sliding plate or bar 23. The plates 20 and 23 can be substantially C or L-shaped. The first and second sliding plates 20 and 23 are set so as to be in an overlapping relationship and are also slidable or movable with respect to each other. In the embodiment of FIG. 4, only one of the sliding plates includes a sloped portion 25 to permit the overlapping positioning of the first and second sliding plates 20 and 23. As further illustrated in FIG. 4, the first sliding plate 20 includes parallel leg portions 20*a* and 20*b* which are slidably positioned over parallel leg portions 23*a* and 23*b* of the second sliding plate 23. The plates 20 and 23 of FIG. 4 when placed in the arrangement illustrated in FIG. 4 define an opening 27 which permits the magnetic portion 17 of FIG. 3 to pass therethrough. The first sliding plate 20 is integrally provided with a handle 20' while the second sliding plate 23 is also integrally provided with a handle 23'. It is noted that the handles 20' and 23' are shown for illustrative purposes and any equivalent means which can cause the sliding or moving of the first plate 20 with respect to the second plate 23 can be utilized.

In the same manner as the embodiment of FIG. 1, when the magnetic portion 11 of the male member 17 is passed through the opening 27, a first magnetically attracting surface 28 on the first sliding plate 20 is attracted to the surface 11*b* of the magnetic portion 11, and a second magnetically attracting surface 29 on the second sliding plate 23 is attracted to the surface 11*a* on the magnetic portion 11. This provides for the magnetic and mechanical locking engagement of the male member 17 to the sliding component 15' of the female member. When it is desired to disengage the male member 17 from the sliding component 15' of the female member, in a procedure similar to the procedure of FIG. 1, the sliding plate 20 is slid in the direction of the arrow B' by moving the handle 20' in the direction of the arrow B, while the sliding plate 23 is moved in the direction of the arrow A' by moving the handle 23' in the direction of the arrow A. This procedure enlarges the opening 27 and releases the magnetic attraction and mechanical engagement between the magnetically attracting surfaces 28 and 29 and the surfaces 11*a* and 11*b* of the magnetic portion 11. When the opening 27 is enlarged, the magnetic portion 11 can pass through the opening 27 to thereby enable the disengagement of the male member 17 from the sliding component 15' of the female member.

Figure 5:
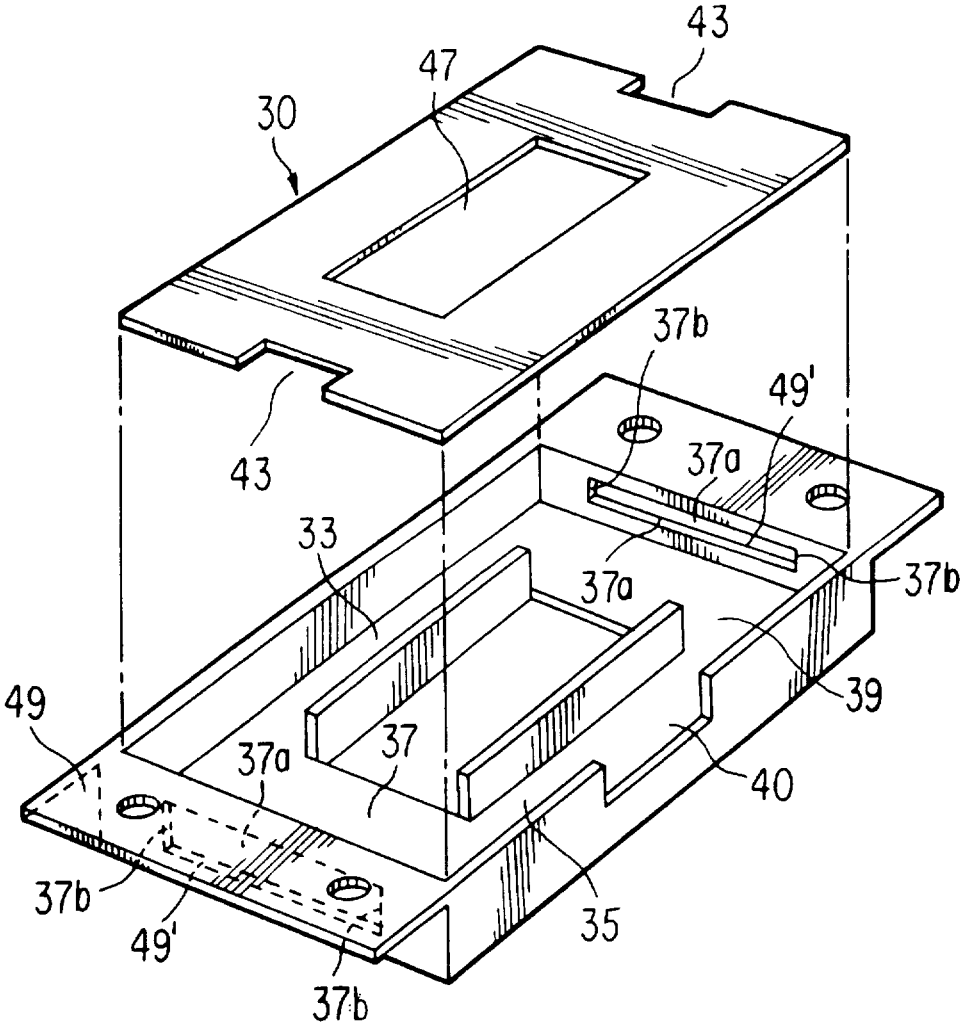
FIG. 5 illustrates an embodiment of a casing for enclosing a sliding component of the female member of the locking device.
Figure 6:
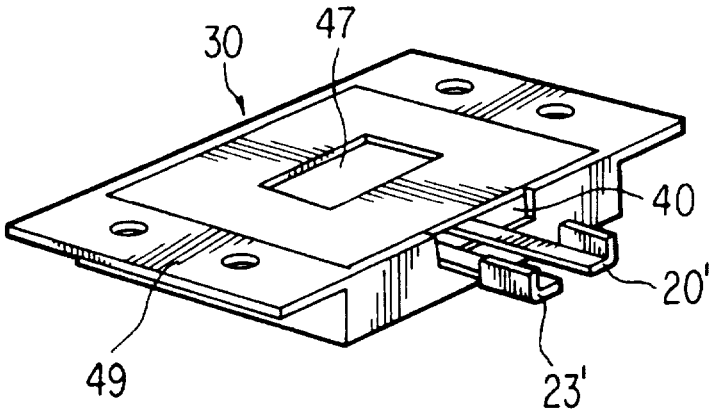
FIG. 6 illustrates the casing of FIG. 5 having a sliding component of the female member inserted therein.

FIG. 5 illustrates a casing 30 which can be utilized to enclose the sliding component of the female member of the present invention. The casing 30 can be a one piece structure which is suitable for inexpensive mass production via plastic injection molding. The casing 30 comprises channels 33 and 35 which can receive the leg portions of for example, the sliding plates illustrated in FIG. 1 or the sliding plates illustrated in FIG. 4. Further included in the casing in FIG. 5 are end receiving portions 37 and 39 for slidably receiving the end members of the sliding plates illustrated in FIGS. 1 and 4. For example, the end members 200 and 202 of the sliding plates 20 and 23 illustrated in FIG. 4 can be slidably positioned in each of the end receiving portions 37 and 39. As a further feature of the casing 30 of FIG. 5, an opening 49' in the form of one way receiving slots can be fabricated at the side ends of each casing. This permits end members such as 200 and 202 illustrated in FIG. 4 to be slid in and held in place by for example locking pins which can catch on lips 37*a* and 37*b* of each of the openings 49'. The casing can further include a slot 40 in the front of the casing or slots 43 on top of the casing. If the embodiment of FIG. 1 is utilized, the slots 43 permit the handles la and 3*a* to pass therethrough. If the embodiment of FIG. 4 is utilized, the slot 40 as illustrated in FIG. 6 permits the handles 20' and 23' to pass therethrough.

The casing further includes an opening 47 which corresponds to the opening 9 of the embodiment of FIG. 1 and the opening 27 of the embodiment of FIG. 4. The flat portions 49 extending from each end of the casing 30 can be used to attach the casing to, for example, the flap or body of a pocketbook.

For ease of manufacturing, the casing can be manufactured as noted above as a one piece structure by injection molding and can include both the slots 40 and 43 and others. This permits a single casing to be adaptable to the embodiment of FIG. 1 and the embodiment of FIG. 4.

Figure 2:
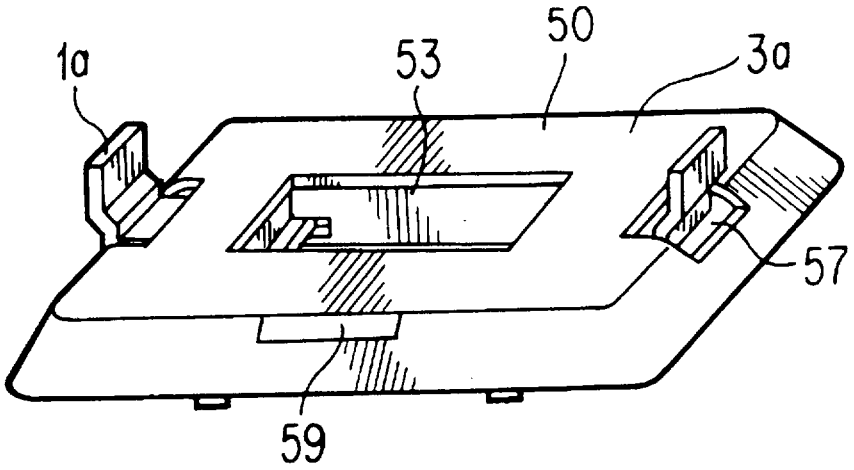
FIG. 2 illustrates the female member of the locking device including a decorative housing.

The casing 30 with the sliding component of FIG. 1 or FIG. 4 inserted therein can be provided within a decorative housing 50 as illustrated in FIG. 2. The decorative housing 50 includes an opening 53 which corresponds to the opening of the casing and the opening defined by the sliding plate members of FIG. 1 or FIG. 4, and also includes slots 57 and/or 59 which corresponds to the slots in the casing 30. The decorative housing can be customized based on a manufacture's preference and can be specific to a Trademark of a specific manufacturer. It is noted that the decorative housing does not have to have the slots or openings illustrated in FIG. 2 since the actuators for achieving the movement of the sliding plates can be hidden under the flap of, for example, a purse.

Figure 7A:
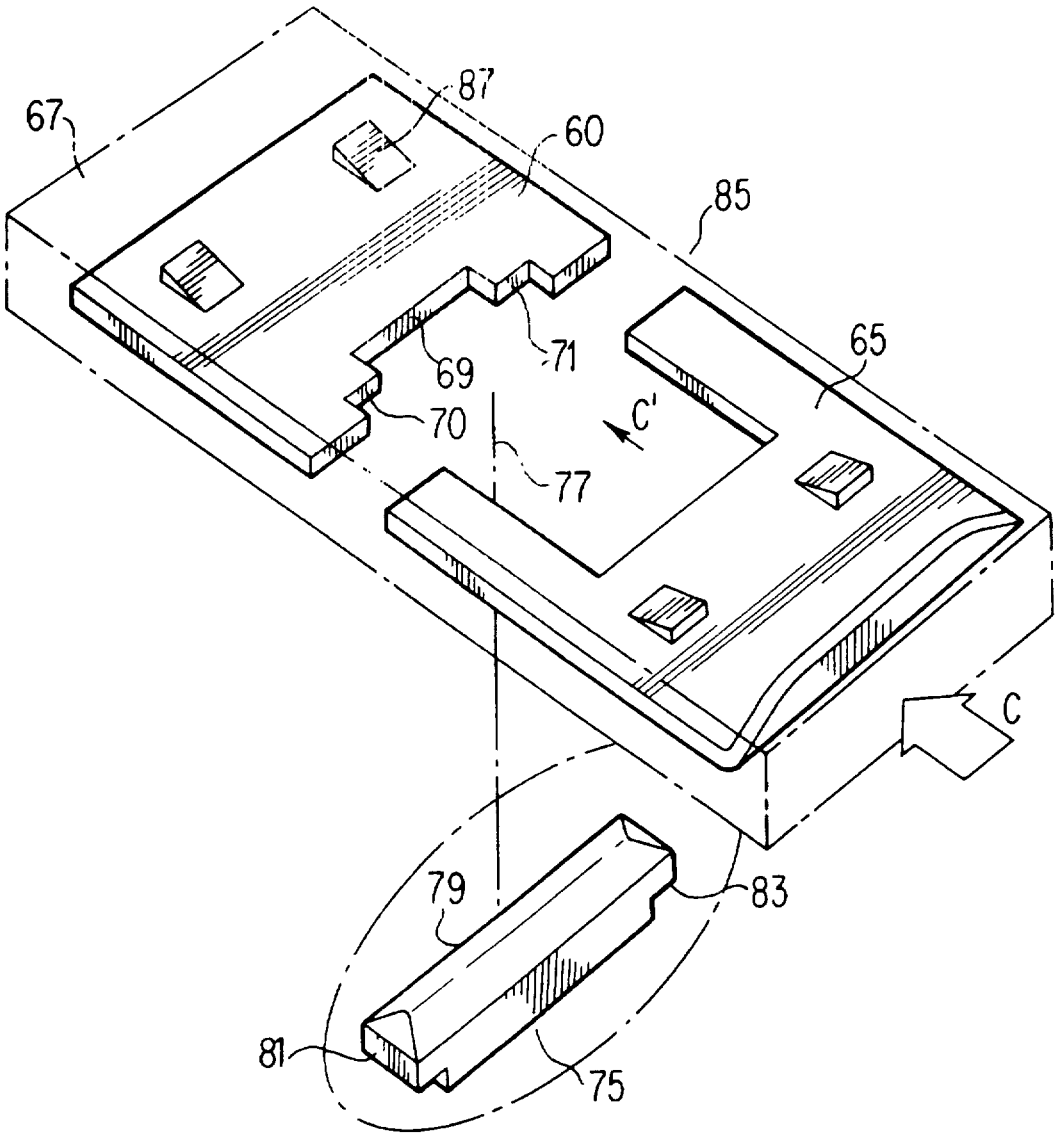
FIG. 7(A) illustrates a third embodiment of the magnetic safety Snap locking device of the present invention.
Figure 7B:
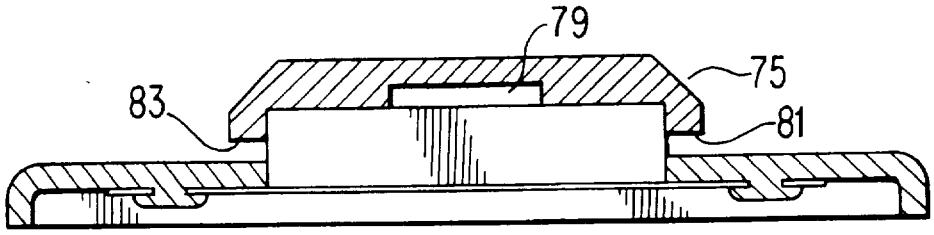
FIG. 7(B) is a cross-sectional view of the magnetic portion of the male member.

FIG. 7(A) illustrates a further embodiment of a sliding component 85 which makes up part of the female member of the present invention. As illustrated in FIG. 7(A), the sliding component 85 of the female member can include a first sliding plate or notched bar 60 which is a locking plate or bar and a second sliding plate or component 65 which is a pusher plate. The locking plate 60 and pusher plate 65 can be positioned within a casing 67 schematically illustrated in FIG. 7(A). The locking plate 60 includes a magnetically attracting face surface 69 and notched end portions 70 and 71. When a magnetic portion 75 as illustrated in FIGS. 7(A) and 7(B) of a male member is inserted through an opening in the casing 67 and through an opening 77 defined between the locking plate 60 and the pusher plate 65, the magnetically attracting face surface 69 of the locking plate 60 is magnetically attracted to a face surface 79 of the magnetic portion 75, and the notched end portions 70 and 71 of the locking plate 60 are magnetically attracted to locking end notched surfaces 81 and 83 of the magnetic portion 75. The face surface 79 of the magnetic portion 75 can be recessed so as to extend above and over the face surface 69 of the locking plate 60 and thereby provide a strong magnetic and mechanical connection.

Thus, when the magnetic portion 75 is inserted through the opening 77 in the female member, the magnetic attraction between the attracting surface 69 and notched end portions 70 and 71 of the locking plate 60, and the surfaces 79, 81 and 83 of the magnetic portion 75 serve to magnetically and mechanically engage the magnetic portion 75 and notches 79, 81 and 83 of the male member with the sliding component 85 of the female member. When it is desired to disengage the magnetic portion 75 from the sliding component 85, the pusher plate 65 is pushed as indicated by arrow C so as to move the pusher plate 65 in the direction of arrow C'. The pusher plate 65 abuts against the locking plate 60 so as to move the surfaces 69, 70 and 71 away from the magnetic surfaces 79, 81 and 83 of the magnetic portion 75. This releases the magnetic attraction and mechanical engagement between the magnetic portion 75 and the locking plate 60 and permits the magnetic portion 75 to pass through the opening 77 to cause the disengagement of the magnetic portion 75 from the sliding component 85.

Reference numeral 87 illustrates one-way locking flanges which can be utilized for slidably inserting each of the plates 60 and 65 into corresponding slots in the housing 67 during manufacture.

FIG. 8(A) illustrates a further embodiment of the sliding component which makes up part of the female member of the present invention. The embodiment of FIG. 8(A) is similar to the embodiment of FIG. 7(A) in that it includes a locking plate 90 and a pusher plate 93 which can be slidably positioned within a casing. For the purposes of illustration, FIG. 8(A) only shows the lower half 95 of the casing. The embodiment of FIG. 8(A) operates in the same manner as the embodiment of FIG. 7(A) in that a magnetic portion 75 of the male member similar to that illustrated in FIGS. 7(A) and 7(B) can be inserted through the opening 97 so as to magnetically attract the surfaces 98, 99 and 100 on the locking plate 90 to corresponding surfaces 79, 81 and 83 on the magnetic portion 75. This creates a positive locking engagement which is both magnetic and mechanical. The embodiment of FIG. 8(A) illustrates a rotatable eccentric cam 101*a*. The rotatable eccentric cam 101*a* can be mounted on a protruding portion or pin 103 on the lower casing 95 so as to be rotatable about the protruding portion or pin 103. The eccentric cam 101*a* includes a cam surface 105 such that a rotation of the eccentric cam 101*a* in the direction illustrated by the arrow causes the cam surface 105 to abut against a facing surface 93' on the pusher plate 93 which thereby causes the pusher plate 93 to abut against the locking plate 90 so as to move the locking plate 90 in a direction similar to the direction illustrated for the movement of the locking plate 60 in FIG. 7(A). This movement causes the locking plate 90 to be moved away from the magnetic portion 75 so as to permit the disengagement of the male member from the sliding component of the female member.

The movement of the pusher plate 93 against the locking plate 90 can also be achieved by utilizing actuators such as those illustrated in FIGS. 8(B), 8(C) and 8(D). FIG. 8(B) illustrates a wedge type actuator 101*b* which can be used to achieve the movement of the pusher plate 93 against the locking plate 90. The lower casing 95 can be adapted to slidably receive the wedge type actuator 101*b* at one end. For example, one of the casing 95 or the wedge type actuator 101*b* can be provided with a protruding pin which can be slidably received in a cooperating channel on the other one of the lower casing 95 or wedge type actuator 101*b*. During use, the wedge type actuator 101*b* can be pushed against the action of a return spring 800 which can also be mounted on the lower casing 95 so as to cause the wedge surface 801 to abut against the facing surface 93' of the pusher plate 93 and thereby push the pusher plate 93 against the locking plate 90. The wedge type actuator 101*b* can also include a locking type flange 803 which can be utilized for slidably inserting the wedge type actuator 101*b* into the casing during manufacture. The return spring 800 serves to return the wedge type actuator 101*b* back to its initial position.

FIGS. 8(C) and 8(D) illustrate lever type mechanisms that can be utilized instead of the cam 101*a* of FIG. 8(A). In FIG. 8(C), a lever type mechanism 101*c* is illustrated. The lever type mechanism 101*c* can be fitted on a protruding portion or pin 103' illustrated in dashed line in FIG. 8(A) which can be positioned on the casing 95. A movement of the lever 101*c* as illustrated by the arrow in FIG. 8(C) causes the abutting surface 806 to abut against the facing surface 93' on the pusher plate 93 which thereby causes the pusher plate 93 to abut against the locking plate 90 so as to move the locking plate 90. The lever type actuator 101*c* can be mounted on the casing 95 by inserting the protruding portion or pin 103' on the casing 95 into an opening 804 on the lever type actuator 101*c* so as to permit a rotation of the lever about the protruding portion or pin 103'.

The lever type actuator 101*d* in FIG. 8(D) is similar to the lever type actuator 101*c* in FIG. 8(C) in that it can be mounted on the lower casing 95 by inserting the protruding portion or pin 103' into an opening 805 on the lever type actuator 101*d*. During use, the operator can rotate the lever as indicated by the arrow in FIG. 8(D) so as to cause the abutting surface 807 to abut against the facing surface 93' on the pusher plate 93 to thereby cause the abutment of the pusher plate 93 against the locking plate 90.

Figure 9A:
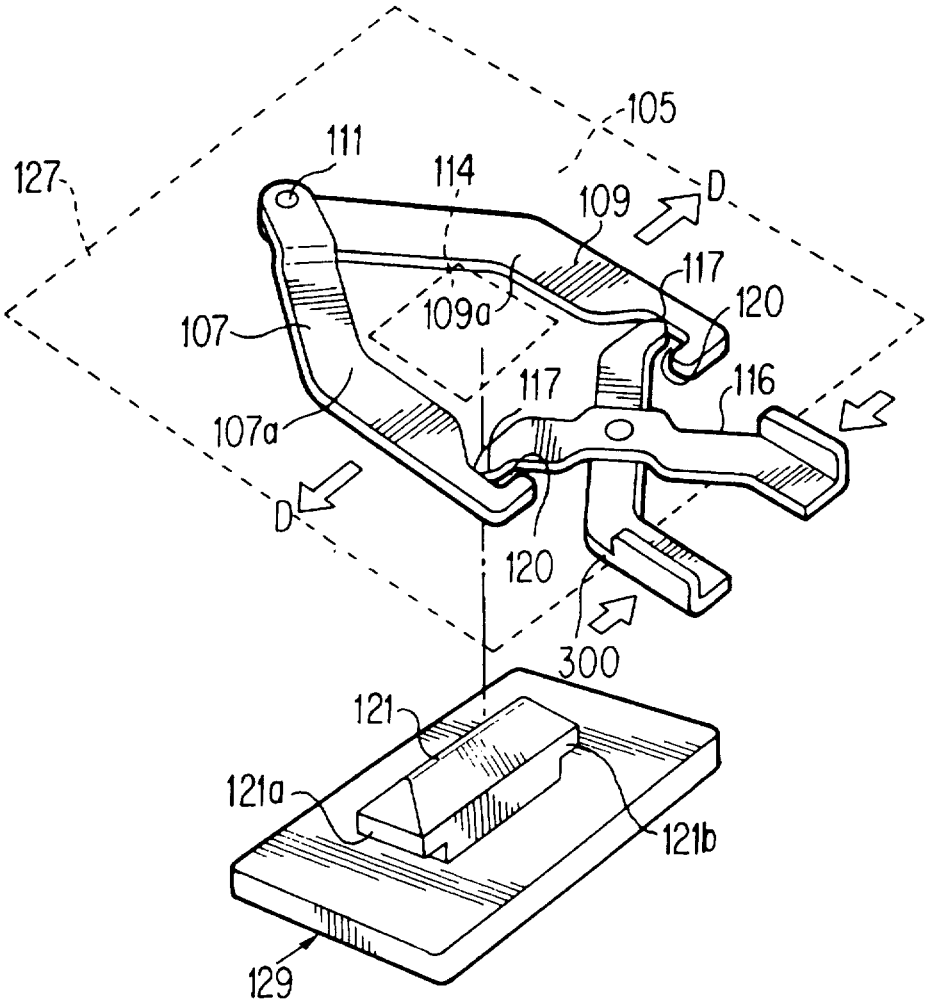
FIG. 9(A) illustrates a fifth embodiment of the magnetic safety snap-locking device of the present invention.

FIG. 9(A) illustrates a further embodiment of a component which makes up part of the female member of the present invention. In FIG. 9(A) the component is a pivoting component and is illustrated by reference numeral 105. The pivoting component 105 comprises a first pivoting member 107 and a second pivoting member 109. The first and second pivoting members 107 and 109 are pivotally attached to each other through a pivot point 111. The pivoting members 107 and 109 are pivoted away from each other by utilizing a scissor-like engagement release device 116. The scissor-like engagement release device 116 includes end portions 117, 117 which abut against hook-like end portions 120, 120 of each of the first and second pivoting members 107 and 109. Pivoting of the scissor-like engagement release device 116 in the direction indicated by the arrows in FIG. 9(A) causes the first and second members 107 and 109 to pivot about the pivot point 111 in the direction of the arrows D as illustrated in FIG. 9(A).

When the magnetic portion 121 of the male member 129 is inserted through an opening 114 defined between the first and second pivoting members 107 and 109, a magnetically attracting surface 107*a* on the pivoting member 107 is attracted to a surface 121*a* of the magnetic portion 121, while a magnetically attracting surface 109*a* on the pivoting member 109 is attracted to a surface 121*b* on the magnetic portion 121. This provides for the magnetic and mechanical engagement of the male member 129 to the pivoting component 105. When it is desired to disengage the male member 129 from the pivoting component 105, the scissor-like engagement release device 116 is operated as explained above to move the pivot members 107 and 109 away from each other and thereby release the magnetic attraction between the magnetic portion 121 and the magnetically attracting surfaces 107*a* and 109*a* of the members 107 and 109. The pivoting component 105 of the female member is disposed in a casing schematically illustrated by reference numeral 127 having an opening which corresponds to the opening 114. The casing also can comprise slot means 300 for permitting the handles of the scissor-like engagement release device to extend therethrough in a manner similar to the slot means of the casing of FIG. 6. In all of the embodiments, the casing can be positioned in a decorative housing which can be customized based on the preference of the specific manufacturer.

Figure 9B:
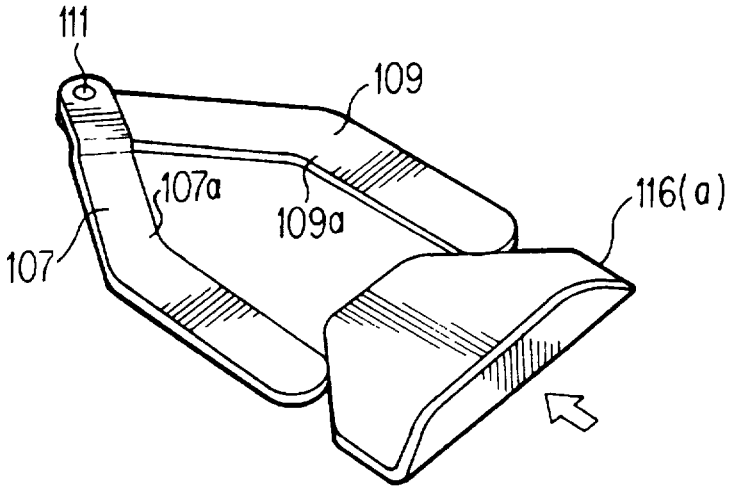
FIG. 9(B) illustrates the embodiment of FIG. 9(A) with a different type of actuator.

An alternate device for achieving the pivoting of the pivoting members 107 and 109 is illustrated in FIG. 9(B). In FIG. 9(B), a wedge member 116*a* is utilized instead of the scissor-like engagement release device 116 of FIG. 9(A). The wedge device 116*a* is pushed in the direction indicated by the arrow in FIG. 9(B) to achieve the pivoting of the pivoting members 107 and 109 away from each other to release the magnetic attraction between the magnetic portion 121 and the magnetically attracting surfaces 107*a* and 109*a* of the members 107 and 109. The casing for housing the pivoting component 105 can be modified to permit the insertion of the wedge member 116*a*.

Figure 10:
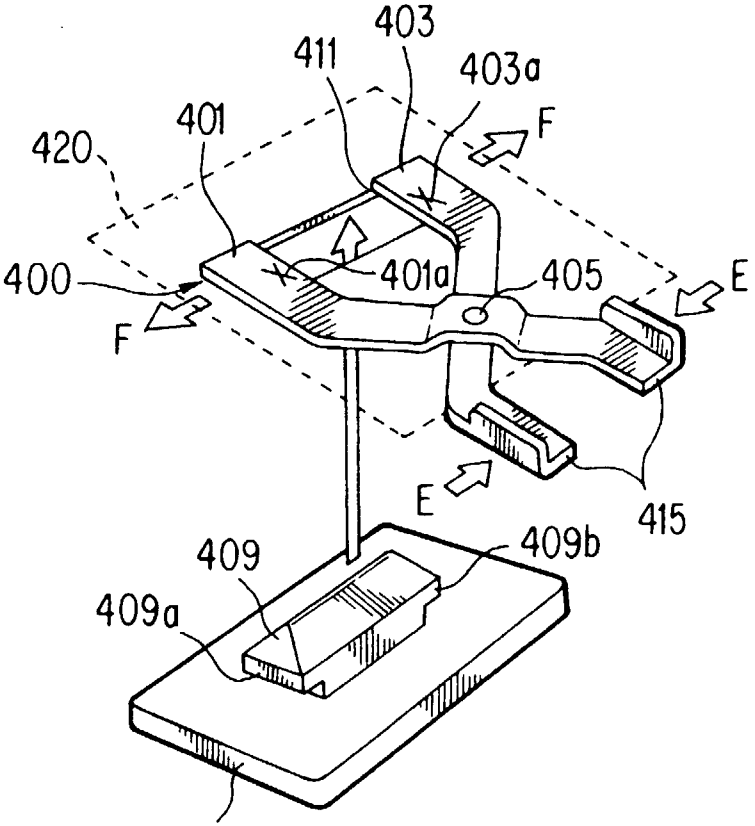
FIG. 10 is a sixth embodiment of the magnetic safety snap locking device of the present invention.

FIG. 10 illustrates a further embodiment of a component 400 which makes up part of the female member of the present invention. In FIG. 10, the component 400 is a pivoting component in the form of a scissor-like attraction member. The scissor-like attraction member comprises a first member 401 and a second member 403 which are pivotally attached to each other about a pivot point 405. The first member 401 comprises a first magnetically attracting surface 401*a*, and the second member 403 comprises a second magnetically attracting surface 403*a*. In the embodiment of FIG. 10, a further member for achieving the pivoting of the first and second members 401 and 403 is not necessary due to the fact that the component 400 is in the form of a scissor-like attraction member.

During use of the embodiment of FIG. 10, a male member 407 having a magnetic portion 409 is inserted through an opening 411 defined between the first and second pivoting members 401 and 403. When the magnetic portion 409 is inserted through the opening 411, the first magnetically attracting surface 401*a* is attracted to a first portion 409*a* on the magnetic portion 409, while the second magnetically attracting surface 403*a*, is magnetically attracted to a second portion 409*b* on the magnetic portion 409. This achieves the magnetic and mechanical engagement between the male member 407 and the component 400 of the female member.

When it is desired to release the engagement between the male member 407 and the component 400 of the female member, the component 400 is pivoted about the pivot point 405 by moving the handles 415 in the direction illustrated by the arrows E in FIG. 10. This moves the magnetically attracting surfaces 401*a* and 403*a* in the direction illustrated by the arrows F so as to release the magnetic attraction and thus the mechanical attachment between the magnetically attracting surfaces 401*a* and 403*a* and the magnetic portion 409. The male member 407 can then be passed through the opening 411. The component 400 can be positioned within a casing schematically illustrated by reference numeral 420 having an opening which corresponds to the opening 411 and also having a slot means for permitting the handles 415 to extend therethrough or throughholes for permitting other types of actuation means to extend therethrough.

Figure 11:
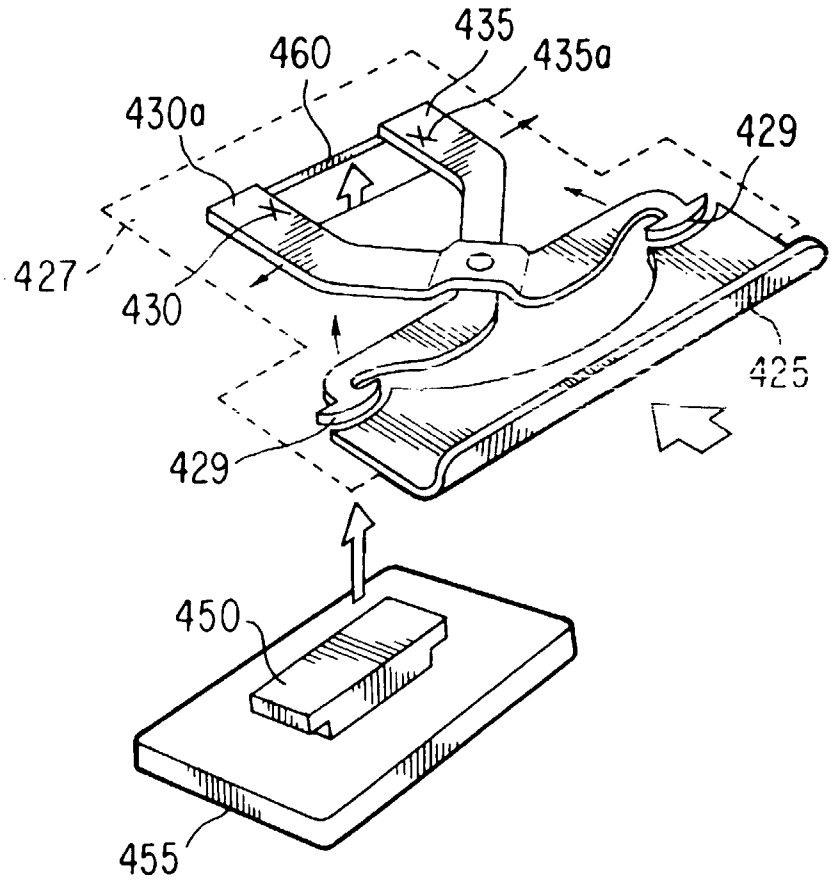
FIG. 11 is a seventh embodiment of the magnetic safety snap locking device the present invention.

FIG. 11 illustrates a further embodiment similar to the embodiment in FIG. 10 but including an actuator or push plate for achieving the pivoting of the pivoting members. The housing 427 as illustrated in FIG. 11 can be expanded to permit the push plate or actuator 425 to be positioned adjacent to end portions 429, 429 of the pivoting members 430 and 435. The embodiment with respect to the pivoting members of FIG. 11 works in a similar manner to the embodiment of FIG. 10. In FIG. 11, the single push plate or actuator 425 can be utilized to achieve the pivoting of the first and second members 430 and 435 so as to permit the attracting surfaces 430*a* and 435*a* on the pivoting members 430 and 435 to be moved away from the magnetic portion 450 of the male member 455, when the male member 455 is inserted through the opening 460 which is defined between the first and second pivoting members 430 and 435. The housing 427 of FIG. 11 includes an opening which corresponds to the opening 460 defined between the pivoting members 430 and 435.

FIGS. 12A and 12B illustrate an example of the use of the locking device of the present invention. In FIGS. 12A and 12B a hand-bag or pocket book 700 is illustrated. A male member such as that illustrated in FIG. 3 can be positioned on one portion of the pocket book 700 as illustrated by reference numeral 500 in FIG. 12B. A female member 600 which comprises, for example, the sliding component of FIG. 1 housed in a housing, as illustrated in FIG. 5, and positioned in a decorative casing, as illustrated in FIG. 2, can be positioned on the flap of the pocket book as illustrated by reference numeral 600 in FIG. 12A. Accordingly, during use, the flap with the female member 600 positioned thereon is directed to the portion of the pocket book which has the male member 500 positioned thereon so as to achieve the magnetic and mechanical engagement between the male member 500 and female member 600.

Obviously, numerous modifications and variations of the present invention are possible in light of the above teachings. It is therefore to be understood that within the scope of the appended claims, the invention may be practiced otherwise than as specifically described herein.

WHAT IS CLAIMED AS NEW AND DESIRED TO BE SECURED BY LETTERS PATENT OF THE UNITED STATES IS:

1. A magnetic safety snap locking device comprising:

a male member having a magnetic portion;

a female member comprising first and second overlapping plates which are movable with respect to each other, said first and second overlapping plates defining a first opening for permitting the magnetic portion of the male member to be inserted therethrough, said first plate comprising a first magnetically attracting surface and said second plate comprising a second magnetically attracting surface, each of said first and second magnetically attracting surfaces being attracted to said magnetic portion of said male member when said magnetic portion is inserted through said first opening so as to magnetically and mechanically engage said male member to said female member; and moving means operationally connected to each of said first and second plates for moving each of said first and second plates with respect to each other to enlarge said first opening and move the first and second attracting surfaces of the first and second plates away from the magnetic portion of said male member, to thereby permit said magnetic portion to pass through said first opening so as to disengage said male member from said female member.

2. The device according to claim 1, wherein said first and second overlapping plates are substantially C-shaped.

3. The device according to claim 1, wherein said first and second overlapping plates are substantially L-shaped.

4. The device according to claim 1, wherein said moving means protrudes forwardly from a front edge of each of said first and second plates.

5. The device according to claim 1, wherein said moving means protrudes vertically upward from side edges of each of said first and second plates.

6. The device according to claim 1, further comprising a casing for enclosing said first and second plates therein, said casing comprising:

channels for receiving said first and second plates;

a second opening which corresponds to said first opening defined by said first and second plates; and at least one first slot for permitting said moving means to pass therethrough.

7. The device according to claim 6, further comprising a decorative housing for housing said casing having said first and second plates positioned therein.

8. The device according to claim 6, further comprising a decorative housing for housing said casing having said first and second plates positioned therein, said decorative housing comprising:

a third opening which corresponds to said second opening of said casing and said first opening defined by said first and second plates; and at least one second slot which corresponds to said at least one first slot on said casing.

9. A magnetic safety snap locking device comprising:

a male member having a magnetic portion, said magnetic portion comprising an end surface and locking end notched surfaces; and a female member comprising first and second plates, said first and second plates defining a first opening between them for permitting the magnetic portion of said male member to be inserted therethrough, wherein one of said first and second plates is a locking plate and comprises a magnetically attracting face surface and notched end portions, such that when said magnetic portion of said male member is inserted through said first opening, said face surface of said locking plate is attracted to said end surface of said magnetic portion of said male member, and said notched end portions of said locking plate is attracted to said locking end notched surfaces of said magnetic portion, to thereby magnetically and mechanically fasten said male member to said female member on at least two sides of the magnetic portion;

wherein the other of said first and second plates is a pusher plate and is slidable in a direction toward said locking plate to abut against said locking plate and move said locking plate away from said magnetic portion, to thereby break the magnetic attraction and mechanical engagement between said face surface of said locking plate and said end surface of said magnetic portion, and the magnetic attraction and mechanical engagement between said notched end portions of said locking plate and said locking end notches of said magnetic portion, and thereby permit said magnetic portion to pass through said first opening and magnetically and mechanically disengage said male member from said female member.

10. The device according to claim 9, wherein said end surface of said magnetic portion defines a recessed portion.

11. The device according to claim 9, wherein said first and second plates are substantially C-shaped.

12. The device according to claim 9 further comprising a casing for enclosing said locking and pusher plates, said casing having a second opening which corresponds to the first opening.

13. The device according to claim 12, further comprising an eccentric cam rotatably mounted on said casing, said cam comprising a cam surface which abuts against an end surface of said pusher plate, such that a rotation of said cam in a first direction pushes said pusher plate in a direction toward said locking plate to cause said movement of said locking plate away from said magnetic portion.

14. The device according to claim 13, wherein said eccentric cam comprises rotation means for rotating said cam, said rotation means extending through a slot in said casing.

15. The device according to claim 12, further comprising a wedge actuator slidably mounted on said casing, said wedge actuator having a wedge surface which abuts against an end surface of said pusher plate when said wedge actuator is slid in a first direction to push said pusher plate in a direction toward said locking plate to cause said movement of said locking plate away from said magnetic portion.

16. The device according to claim 12, further comprising a lever rotatably mounted on said casing, said lever having an abutting surface which abuts against an end surface of said pusher plate, such that a rotation of said lever in a first direction pushes said pusher plate in a direction toward said locking plate to cause said movement of said locking plate away from said magnetic portion.

17. A magnetic safety snap locking device comprising:

a male member having a magnetic portion;

a female member comprising first and second members pivotally attached to each other about a pivot point, said first member comprising a first magnetically attracting surface and said second member comprising a second magnetically attracting surface, said first and second magnetically attracting surfaces being attracted to said magnetic portion when said magnetic portion is inserted through a space defined between said first and second members so as to magnetically and mechanically engage said male member with said female member; and a scissor-like engagement release means, said scissor-like engagement release means abutting against end or side portions of each of said first and second members which are opposite to said pivot point, said scissor-like engagement release means pivoting each of said first and second members about said pivot point in a direction away from said magnetic portion so as to release the magnetic attraction and mechanical engagement between said first and second attracting surfaces and said magnetic portion and permit said magnetic portion to pass through said space, to thereby allow said male member to be magnetically and mechanically disengaged from said female member.

18. The device according to claim 17, further comprising a casing for housing said female member, said casing comprising an opening which corresponds to said space between said first and second members and permits the magnetic portion to be inserted therethrough.

19. The device according to claim 17, wherein said casing comprises at least one slot or hole, said scissor-like engagement release means comprising actuating means which extend through said slot or hole.

20. The device according to claim 17, wherein said end portions of each of said first and second members define a hook shape.

21. A magnetic safety snap locking device comprising:

a male member having a magnetic portion; and a female member comprising a scissor-like attraction member, said scissor-like attraction member comprising first and second members pivotally attached to each other about a pivot point, a first end of said scissor-like attraction member comprising first and second attracting surfaces on respective ones of each of said first and second members, said first and second members defining a first opening at said first end of said scissor-like attraction member for permitting the magnetic portion of said male member to be inserted therethrough, each of said first and second attracting surfaces being magnetically attracted to said magnetic portion when said magnetic portion is inserted through said opening for magnetically and mechanically engaging said male member to said female member;

wherein said first and second members are pivotable about said pivot point to move said first and second attracting surfaces away from said magnetic portion and release the magnetic attraction and mechanical engagement between said first and second magnetically attracting surfaces and said magnetic portion, to thereby permit said magnetic portion to pass through said opening.

22. The locking device according to claim 21, wherein a second end of said scissor-like attraction member which is opposite said first end comprises actuating means for pivoting said first and second members about said pivot point.

23. The locking device according to claim 22, wherein said actuating means is a pusher plate.

24. The locking device according to claim 23, further comprising a casing having at least a second opening which corresponds to the first opening defined by the first and second members and at least a slot through which said actuating means extends.

* * * * *

UNITED STATES PATENT AND TRADEMARK OFFICE

CERTIFICATE OF CORRECTION

PATENT NO. : 5,515,581
DATED : May 14, 1996
INVENTOR(S) : Eli KAUFMAN

It is certified that error appears in the above-indentified patent and that said Letters Patent is hereby corrected as shown below:

On the title page, Item [76], the Inventor's name, should read:

-- [76] Eli KAUFMAN --

Signed and Sealed this

Twenty-fourth Day of September, 1996

*Attest:*

Bruce Lehman

BRUCE LEHMAN

*Attesting Officer*

*Commissioner of Patents and Trademarks*